US006879899B2

(12) United States Patent
Budde

(10) Patent No.: US 6,879,899 B2
(45) Date of Patent: Apr. 12, 2005

(54) METHOD AND SYSTEM FOR AUTOMATIC BUCKET LOADING

(75) Inventor: Steven C. Budde, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 84 days.

(21) Appl. No.: 10/317,208

(22) Filed: Dec. 12, 2002

(65) Prior Publication Data

US 2004/0117092 A1 Jun. 17, 2004

(51) Int. Cl.[7] ..... E02F 3/00; G01M 17/00; A01F 12/00

(52) U.S. Cl. ..... 701/50; 37/348; 172/2

(58) Field of Search ..... 701/50; 56/10.2 G, 56/10.2 R; 460/6; 37/348, 414, 902; 172/2, 811; 318/568.18; 414/699, 718

(56) References Cited

U.S. PATENT DOCUMENTS

| | | | | | |
|---|---|---|---|---|---|
| 4,518,044 | A | | 5/1985 | Wiegardt et al. | 172/7 |
| 4,608,873 | A | * | 9/1986 | Redzinski | 74/336 R |
| 4,984,956 | A | * | 1/1991 | Ikari et al. | 414/699 |
| 5,214,916 | A | | 6/1993 | Lukich | 60/431 |
| 5,528,843 | A | | 6/1996 | Rocke | 37/348 |
| 5,720,358 | A | | 2/1998 | Christensen et al. | 180/53.4 |
| 5,794,369 | A | | 8/1998 | Lee et al. | 37/348 |
| 5,941,921 | A | | 8/1999 | Dasys et al. | 701/50 |
| 5,950,141 | A | * | 9/1999 | Yamamoto et al. | 702/41 |
| 5,968,103 | A | | 10/1999 | Rocke | 701/50 |
| 5,974,352 | A | | 10/1999 | Shull | 701/50 |
| 5,975,214 | A | * | 11/1999 | Okamura et al. | 172/2 |
| 6,064,933 | A | | 5/2000 | Rocke | 701/50 |
| 6,065,904 | A | | 5/2000 | Cook et al. | 405/303 |
| 6,140,787 | A | * | 10/2000 | Lokhorst et al. | 318/568.18 |
| 6,167,336 | A | | 12/2000 | Singh et al. | 701/50 |
| 6,205,687 | B1 | | 3/2001 | Rocke | 37/348 |
| 6,208,925 | B1 | | 3/2001 | Creger et al. | 701/51 |
| 6,234,254 | B1 | | 5/2001 | Dietz et al. | 172/3 |
| 6,246,939 | B1 | | 6/2001 | Nozawa | 701/50 |
| 6,321,153 | B1 | | 11/2001 | Rocke et al. | 701/50 |
| 6,584,710 | B1 | * | 7/2003 | Lin et al. | 37/348 |
| 6,591,591 | B2 | * | 7/2003 | Coers et al. | 56/10.2 G |

* cited by examiner

*Primary Examiner*—Tan Q. Nguyen
*Assistant Examiner*—Dalena Tran
(74) *Attorney, Agent, or Firm*—Finnegan, Henderson, Farabow, Garrett & Dunner

(57) ABSTRACT

A method for controlling an automatic bucket control system during loading of a work implement of a work machine is disclosed. The method includes the steps of determining when the work implement engages a pile of material, initiating the automatic bucket control system in response to the work implement engaging the pile of material, determining a ground speed of the work machine, and generating a lift command based upon the ground speed. After fully engaging the material, the system may further adjust tilt commands and/or lift commands based upon a monitored crowd factor to control operation of the work implement.

27 Claims, 7 Drawing Sheets

METHOD AND SYSTEM FOR AUTOMATIC BUCKET LOADING

TECHNICAL FIELD

This invention relates generally to an automated bucket loading cycle for a digging operation and, more particularly, to a method and system for controlling the automated bucket loading cycle.

BACKGROUND

Work machines, for example, wheel loaders, track loaders, and the like, having work implements, such as buckets, are often used to dig material from one location, and dump the material at one or more other locations. For example, wheel loaders having buckets are used to dig materials such as gravel, sand, soil, and the like, and dump the material into the bed of a truck, or at other sites.

In a work environment in which the dig and dump process is performed repeatedly for long periods of time, it is desired to work as efficiently and productively as possible. However, as fatigue sets in, or if the operator is relatively inexperienced, the dig cycle may not be as productive as desired. This adversely impacts the efficiency of the work machine.

As a result, attempts have been made to automate the dig process to maximize productivity and efficiency. For example, it is known to automate the loading process of a work machine, such as a wheel loader, by monitoring various crowd factors as the bucket of the machine enters a pile of material. During the initial phase of the process, known systems determine that the bucket has entered the pile, and responsively begin to lift the bucket rapidly. The systems then tilt the bucket back as it continues to be lifted in a controlled manner.

The known systems are designed to operate with the engine of the work machine at full speed. However, there are situations where it is desired to push into a pile of material with the engine at a speed less than full throttle. For example, the ground may be wet or sandy, and thus not able to provide good traction. Maintaining the engine at full speed may then cause the work machine to slip excessively as it enters the pile. When the engine is operated at less than full speed, however, the known systems continue to command the same lift velocity as if at full speed. This may result in the bucket rising out of the pile without the automated dig cycle loading the bucket to capacity.

One improvement on the known systems is disclosed in commonly-owned U.S. Pat. No. 6,321,153 to Rocke et al. (the '153 patent). The '153 patent discloses a method which automates the loading process of a work machine by determining an actual engine speed relative to a full engine speed, and generating a lift velocity command that is based on a comparison of the actual engine speed to full engine speed.

However, the known systems, including the system of the '153 patent, do not account for the engine speed at less than the full engine speed or the ground speed at less than the maximum ground speed for a given gear. Furthermore, the known systems do not address the situation that arises when an operator downshifts when entering a pile, which may change engine speed, and consequently change the lift command.

Moreover, existing systems, including the system of the '153 patent, operate as though the bucket were always in the pile, once the systems are activated. Accordingly, if the system is activated by a small pile placed in front of a second larger pile, the bucket may rise so high before engaging the second pile that it does not capture a full load from the second pile.

The present invention is directed to overcoming one or more of the disadvantages set forth above or other disadvantages in the prior art.

SUMMARY OF THE INVENTION

In one aspect of the invention, a method for controlling an automatic bucket control system during loading of a work implement of a work machine is disclosed. The method includes the steps of determining when the work implement engages a pile of material, initiating the automatic bucket control system in response to the work implement engaging the pile of material, determining a ground speed of the work machine, and generating a lift command based upon the ground speed.

In another aspect, the invention is a method for automatically operating tilt and lift actuators for loading a work implement of a work machine with material using an automatic control system. The method comprises monitoring a crowd factor and determining when the work implement engages the material based on the monitored crowd factor exceeding a first value. The method also includes determining an actual ground speed of the work machine and generating a lift command and sending the command as a signal to the lift actuator, the lift command being based on the actual ground speed. The method includes determining when the work implement fully engages with the material based on the monitored crowd factor exceeding a second value. Tilt and lift commands are adjusted based on the monitored crowd factor.

It is to be understood that both the foregoing general description and the following detailed description are exemplary and explanatory only and are not restrictive of the invention, as claimed.

BRIEF DESCRIPTION OF THE DRAWINGS

The foregoing and other features and advantages of the invention will be apparent from the following, more particular description of the invention, as illustrated in the accompanying drawings.

DETAILED DESCRIPTION

Embodiments of the present invention are now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
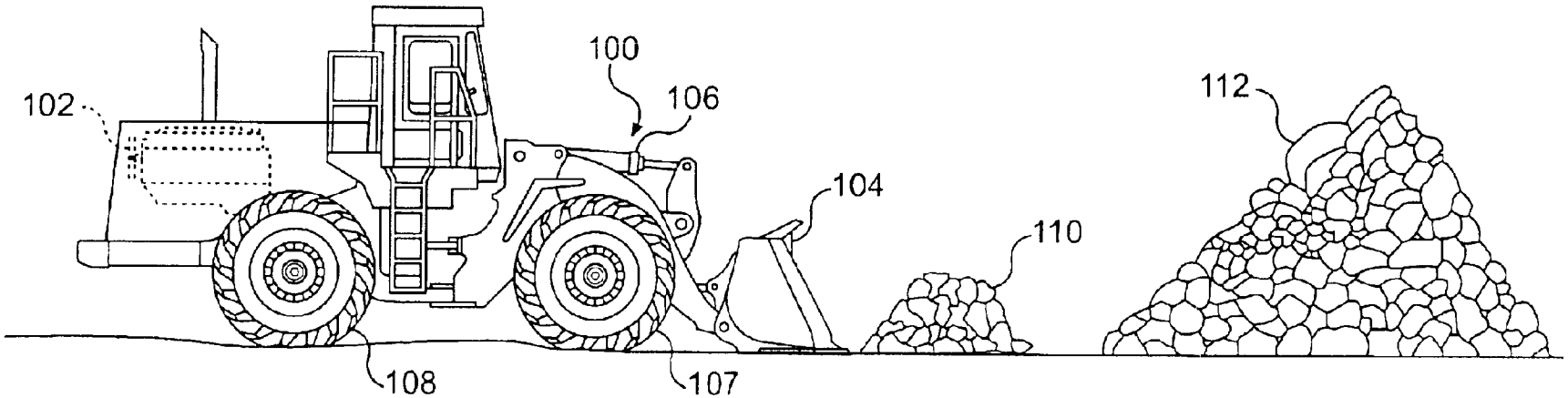
FIG. 1 is a diagrammatic illustration of a work machine juxtaposed with piles of material.

Referring to FIG. 1, a work machine 100 is illustrated approaching a first pile of material 110 and a second pile of material 112. First pile of material 110 and second pile of material 112 may be any of a variety of materials that are to be loaded into the work implement 104 and dumped at another location. For example, first and second piles 110, 112 may include gravel, sand, dirt, and the like. Of course, a work machine may encounter any number of variations in piles of material to be loaded during its course of operation. It is understood that the reference to piles of material encompasses any collection of material to be loaded.

The work machine 100 is depicted as a wheel loader in FIG. 1. However, other types of work machines, e.g., track loaders, backhoe loaders, excavators, front shovels, and the like, may be used as well with exemplary embodiments of the present invention.

The work machine 100 is powered by an engine 102, such as, for example, an internal combustion engine. In addition, the work machine 100 includes a work implement 104, such as, for example, a bucket for digging and loading. In the example of work machine 100 being a wheel loader, the work implement 104 is powered and controlled by a lift actuator (not shown) and a tilt actuator 106. Lift and tilt actuators may be, for example, hydraulic fluid cylinder actuators. However, lift and tilt actuators could be other actuators, as would be apparent to one skilled in the art.

Work machine 100 includes front wheels 107 and rear wheels 108, which support work machine 100 and are powered by engine 10, as is known in the art. While a wheeled work machine is shown and described, one skilled in the art will appreciate that track-type work machines may also be utilized.

Figure 2:
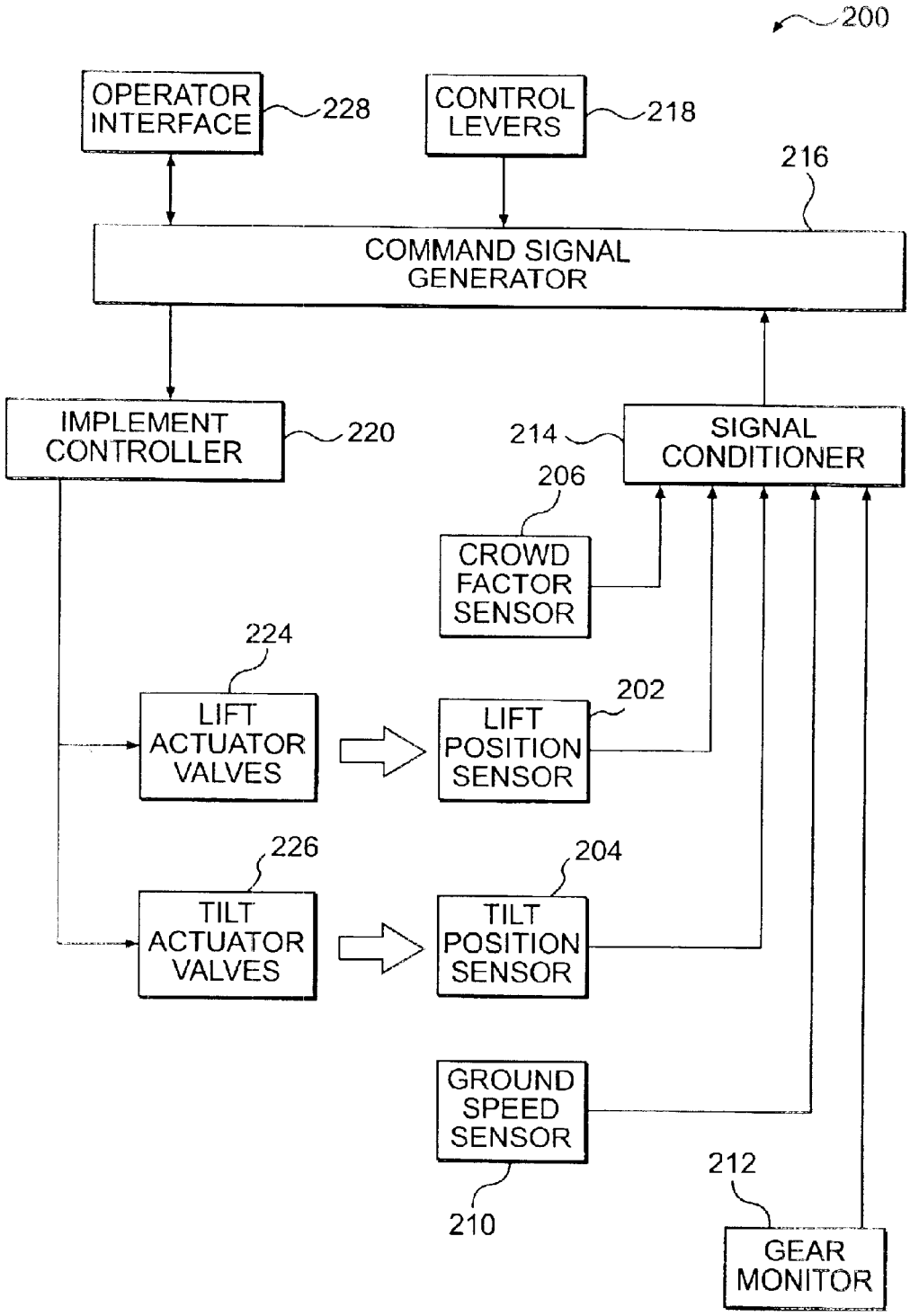
FIG. 2 is a block diagram of an exemplary embodiment of a control system used to automatically control the work implement of the work machine.

FIG. 2 is a block diagram of a control system 200 for work machine 100 according to one exemplary embodiment of the present invention. Lift and tilt position sensors 202, 204, respectively, produce signals in response to the position of the work implement 104 by sensing, for example, the extension of the lift actuator (not shown) and the tilt actuator 106. The position may be sensed, for example, by radio frequency resonance sensors or derived from work implement joint angle measurements using rotary potentiometers, yo-yos, or the like to measure rotation of the actuators.

A crowd factor sensor 206 produces signals representative of a monitored crowd factor. A crowd factor may be one or more of various machine parameters which are monitored to determine the amount of crowding of piles of material, such as first and second piles 110, 112 of FIG. 1. The crowd factor sensor 206 may measure, for example, force, pressure, or speed, depending on the crowd factor being monitored. For instance, the crowd factor parameters could be torque of work machine 100, wheel slip, ground speed, engine speed, lift force, tilt force, and the like to determine the forces being placed on the work implement 104. In one exemplary embodiment, crowd factor sensor 206 represents two or more sensors monitoring different crowd factors.

A speed sensor 210 produces a signal representative of ground speed of the work machine 100. In one exemplary embodiment, the speed sensor is configured to measure the rotational speed at the output of the work machine transmission. However, the speed sensor could be any speed sensor as would be apparent to one skilled in the relevant art. The transmission gear may be readily determined from a gear monitor 212.

The position, force, speed, and gear signals may be delivered to a signal conditioner 214 for conventional signal excitation and filtering, and then provided to the command signal generator 216. The command signal generator 216 may be, for example, a microprocessor-based system that utilizes arithmetic units to generate signals mimicking those produced by control levers 218 according to software programs stored in memory. By mimicking command signals representative of desired lift/tilt actuator movement direction and velocity conventionally provided by control levers 218, the present invention can be advantageously retrofit to existing machines by connection to implement controller 220 in parallel with, or intercepting, the manual control lever inputs.

Alternatively, an integrated controller may be provided by combining command signal generator 216 and programmable implement controller 220 into a single unit in order to reduce the number of components. A machine operator may optionally enter control specifications, such as material condition settings, through an operator interface 228 such as, for example, an alphanumeric key pad, dials, switches, or a touch sensitive display screen.

The implement controller 220 includes hydraulic circuits having lift and tilt actuator control valves 224, 226 for controlling the rate at which pressurized hydraulic fluid flows to respective lift and tilt hydraulic actuators in proportion to received command signals, in a manner well known to those skilled in the art.

Figure 3:
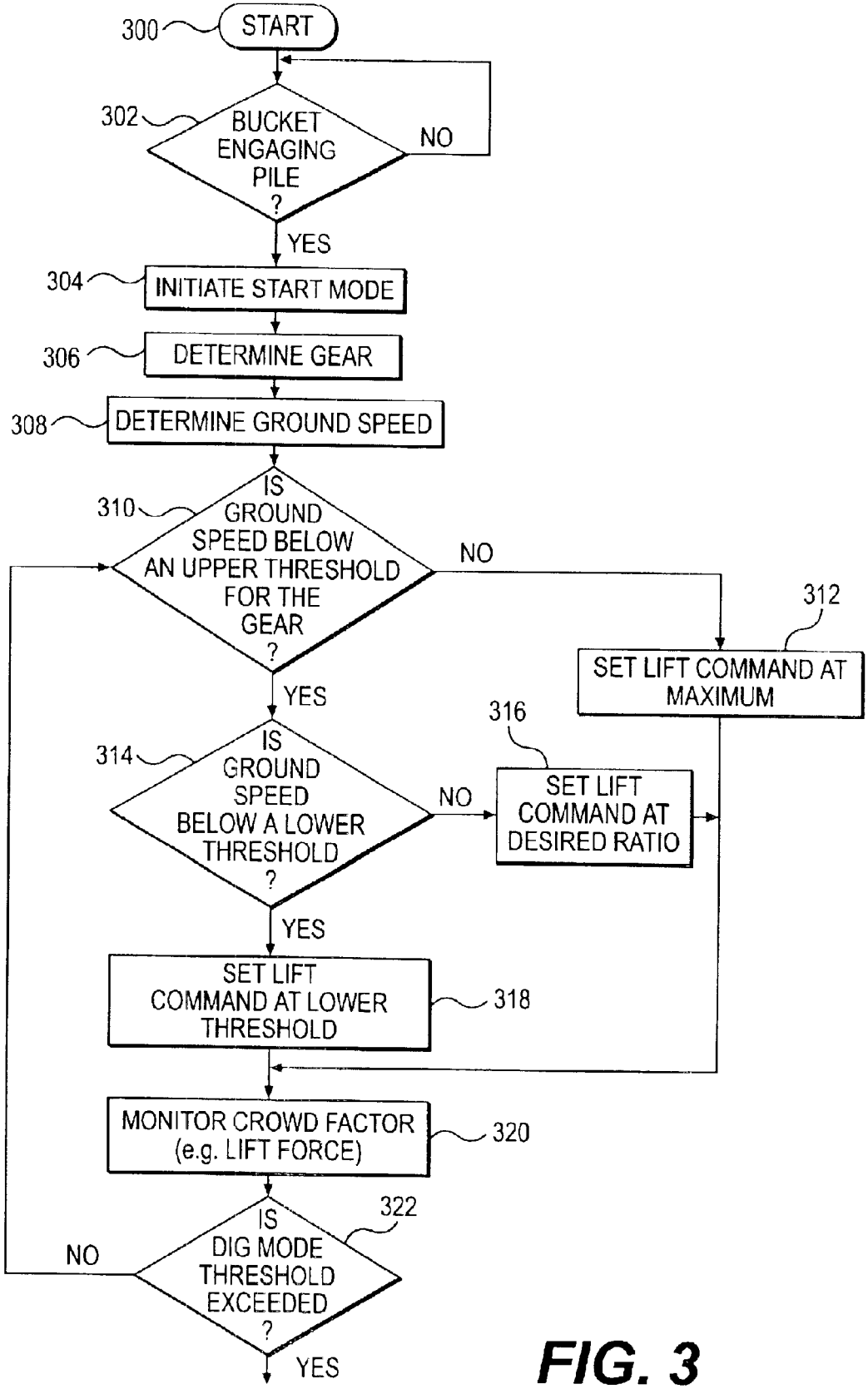
FIG. 3 is a flow diagram illustrating an exemplary embodiment of the method of the present invention.
Figure 3:
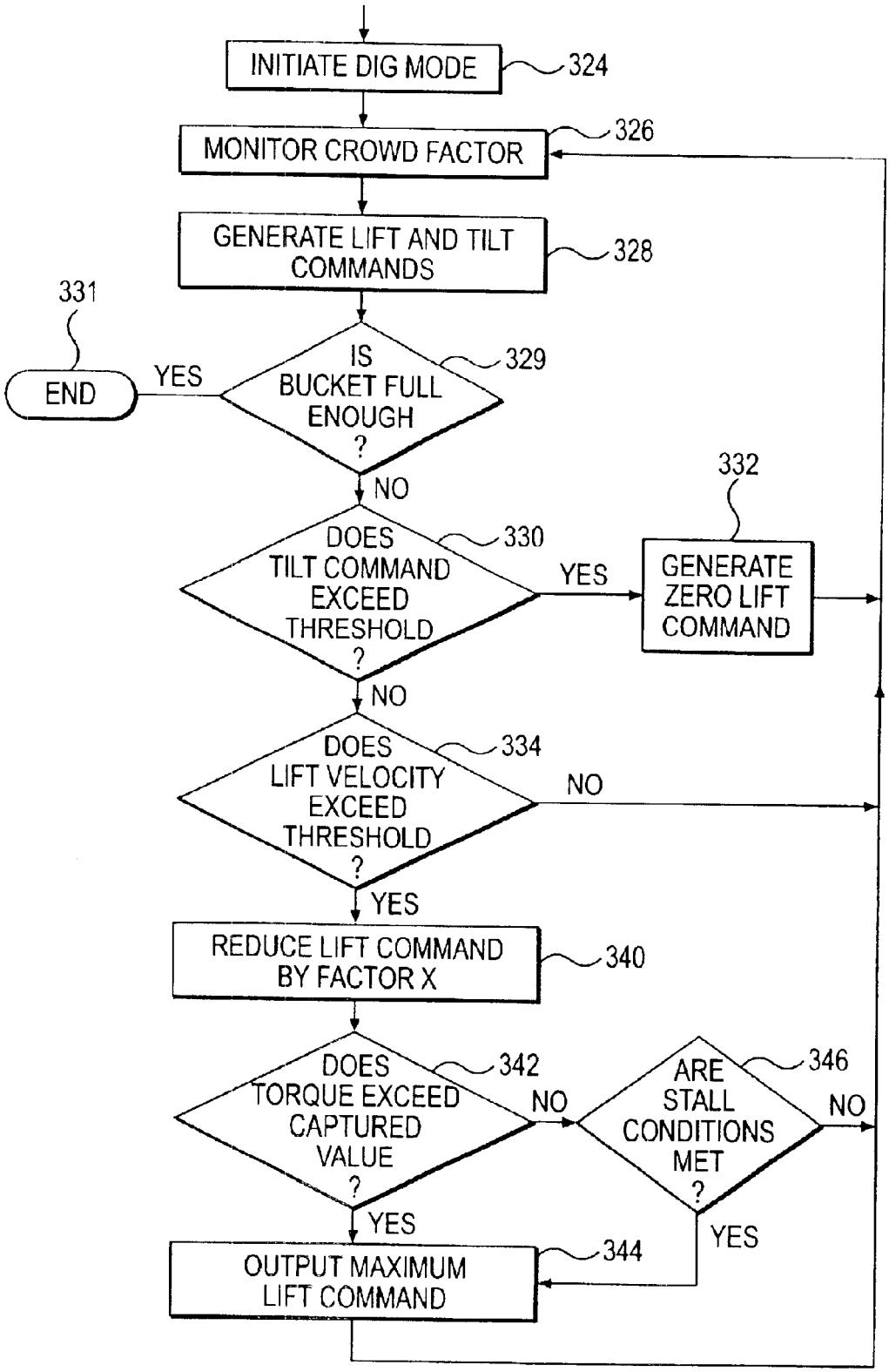

FIG. 3 is a flow chart of the operation of an exemplary embodiment of the control system utilized to control the work implement 104 so that the work implement may efficiently capture full loads from the pile of materials 110 and 112. The control system will be explained with reference to an exemplary embodiment wherein the monitored crowd factor is resistance to lift. However, as explained above, the monitored crowd factor could be any of a variety of crowd factors. Resistance to lift, or lift force, can be measured by crowd factor sensor 206, which could be, for example, pressure transducers, located within the heads of the lift actuators, such as the hydraulic powered lifting cylinders.

The system and process is described with reference to lift and tilt commands and lift and tilt velocities. The lift and tilt commands are the control signals sent from the control system to open the valves by a percentage of a maximum or to a fully open position. The lift and tilt velocities are the actual tilt and lift velocities of the work implement. These velocities are determined not only by the command settings, but by the resistance to lift and tilt, as would be apparent to one skilled in the art.

The system and method begins at a step of starting the automatic control system at a start step 300. The start step may include throwing a toggle switch, a button or otherwise powering the system using a switch on operator interface 228. In one exemplary embodiment, the system is powered at all times that the work machine is operating.

At a step 302, the system determines whether the work implement 104 has engaged a pile of material, such as first pile of material 110. As discussed earlier, this determination may be made by monitoring one or more crowd factors. In one embodiment, the monitored crowd factors are ground speed, engine speed, and driveline torque. Accordingly, when the ground speed, engine speed, and driveline torque deviate from standard driving values to pre-established thresholds, the system determines that the work implement has engaged a pile of material. When the system determines that the work implement 104 has engaged the pile 110, the control system initiates an automated bucket loading process, or START mode, at a step 304.

At a step 306, the system detects which transmission gear the work machine is in by means of, for example, gear monitor 212. The control system may be configured to control the working implement 104 differently for each gear. For instance, certain preset threshold values may be established for each gear, as is explained below with reference to FIG. 4.

At a step 308, the ground speed of the work machine 100 is determined using ground speed sensor 210. As explained above, ground speed sensor 210 could be any standard speed sensor known in the art In one embodiment, signals representing the actual ground speed are sent to the command signal generator 216. The ground speed is used to determine the lift command to be sent to implement controller 220 and lift actuator valve 224 of the work implement. The lift command setting is a factor in generating a lift velocity, and is determined by comparing the ground speed to an upper and lower threshold for a particular gear. At a step 310, the command signal generator 216 determines whether the ground speed is below an upper ground speed threshold for the gear. If the ground speed is not below the set upper threshold for the gear, the lift command is set at a preset value, such as, for example, 100%, thereby maximizing the lift velocity.

Figure 4:
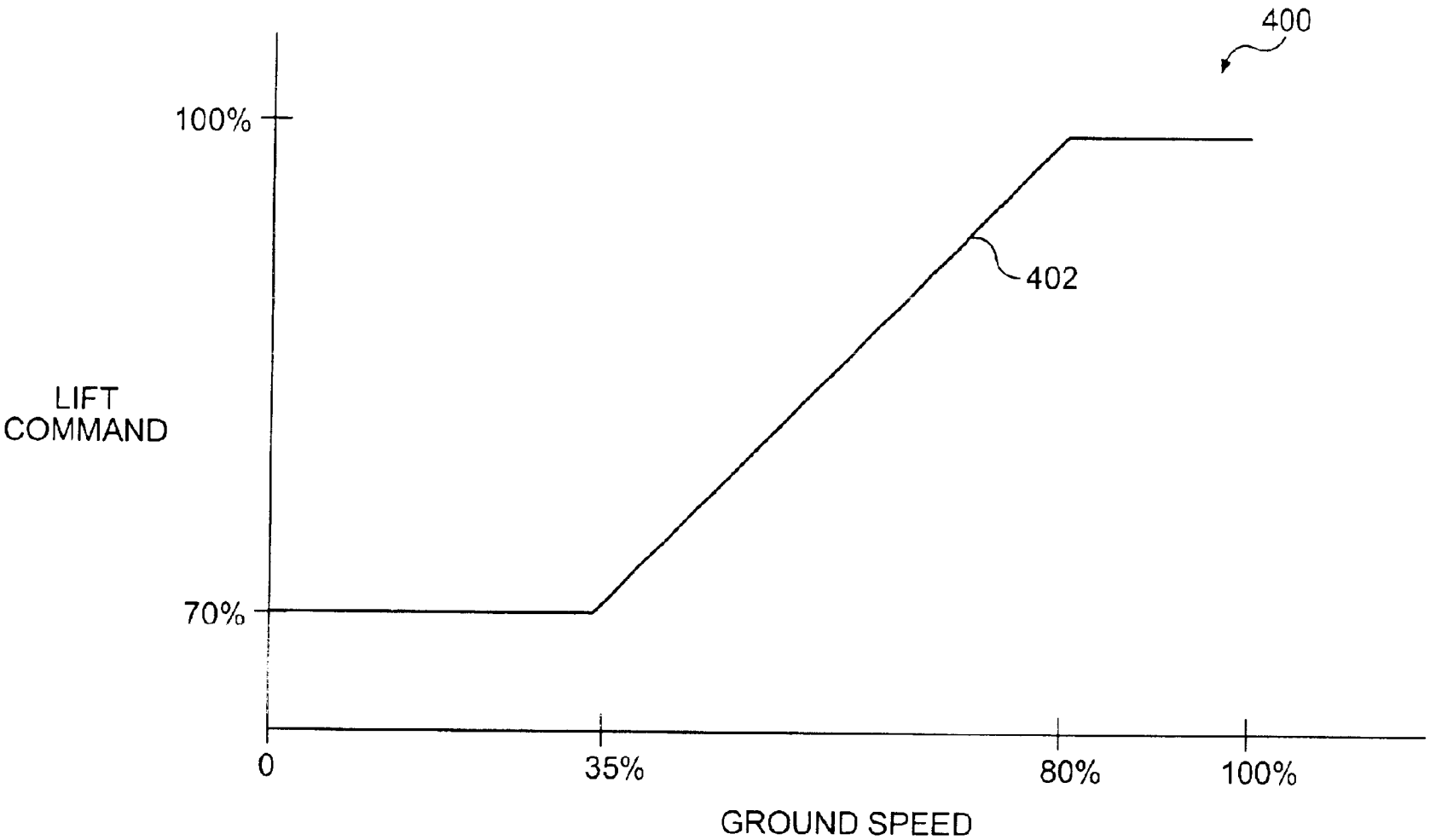
FIG. 4 is a graph showing an exemplary relationship between the lift command and the ground speed of the work machine for a single transmission gear.

FIG. 4 is a graph 400 displaying an exemplary correlation between the ground speed and the lift command. In graph 400, the vertical axis represents the lift command as a percentage of the maximum lift capacity of the lift actuator for the material selected. The horizontal axis represents the ground speed as a percentage of the maximum ground speed of the work machine for a single gear. A plotted line 402 represents the lift command based on the ground speed. Each gear may have a different relationship between the lift command and the ground speed. Likewise, the upper and lower thresholds for each gear may be different. It is to be understood that the lift command ratio may be determined by other means as well, such as a table of command or velocity ranges, a non-linear reduction curve, and the like, without deviating from the spirit of the present invention.

As shown in graph 400, the upper threshold of the ground speed is 80% of the maximum ground speed for the gear. Accordingly, if at step 310 in FIG. 3, the ground speed were 80% or greater of the maximum speed for the gear, then the lift command would be maximized at 100% of capacity. As such, at step 310, the method proceeds along the "no" line to a step 312 which sets the lift command at 100%, maximizing the lift velocity.

If at step 310 the ground speed is below the upper threshold for the gear, then the process proceeds to step 314, where the command signal generator 216 compares the ground speed to a preset lower threshold. If, at step 314, the ground speed is not below the lower threshold, the command signal generator 216 sets the lift command at a desired ratio, at a step 316. At step 316, the lift velocity is reduced in response to the actual ground speed being less than maximum ground speed for the gear. The lift velocity may be reduced by adjusting the lift command to the work implement 104. Accordingly, returning to FIG. 4, if the ground speed were at some value less than 80% of the maximum ground speed for the gear, such as 50%, then the lift command would be set at a corresponding ratio on the graph line 406.

If the ground speed is below the lower threshold at step 314, the lift command is set at a lower lift threshold, as shown at step 318. Setting the lift command at a threshold minimum ensures that even when the work machine is advancing very slowly into first and second piles 110, 112, the lift will not stop altogether, but will continue to function to effectively reduce the chance of slipping of the tires. For example, FIG. 4 shows the lower threshold for the ground speed at 35% of the maximum ground speed. Accordingly, if it is determined that the actual ground speed of the work machine is some value below 35% of maximum ground speed for the gear, the lift command will be set at a minimum threshold value of, for example, 70% of the full lift command.

The system continually monitors a crowd factor, as described at step 320. As explained above, this example is described using lift force as the monitored crowd factor. The lift force is monitored to determine when the system will advance from START mode to DIG mode.

At a step 322, the system continuously checks to determine whether a preset DIG mode threshold is exceeded, indicating that one of the first and second piles of material 110, 112 is fully engaged. The DIG mode threshold is preset to represent that the bucket has dug into and fully "engaged" the pile. Accordingly, when the DIG mode threshold is exceeded by the lift force (the monitored crowd factor), the system determines that the work implement is fully engaged within the pile, and the mode advances from START mode to DIG mode in a step 324. If the DIG mode threshold is not exceeded, then the system continues to operate in START mode, basing the lift command on the previously determined command described with reference to step 314.

At a step 324, the DIG mode is initiated, thereby ending the START mode control system. In the DIG mode, the lift force (monitored crowd factor) is continuously monitored at a step 326. The lift force is monitored in the same fashion as described with regard to the START mode. At a step 328, the control system generates tilt command signals in proportion to lift force. At the same time, the lift command signals may be eliminated or reduced to a partial lift command level in an inverse relationship to the tilt velocity as described below.

In this exemplary embodiment of the DIG mode, the tilt command is based upon, and set to operate in proportion to the lift force, the lift force being the measured crowd factor. The tilt velocity is controlled by a tilt command sent by the implement controller 220 to the tilt valves 226. Accordingly, when the lift force is high, the tilt command is set so that the tilt velocity is high. The tilt command need not have a direct proportional relationship to the lift force, but may generally increase and decrease with respect to an increase or decrease in lift force.

The lift command is based upon, and operates inversely to the tilt command. The lift velocity is controlled by the lift command sent by the implement controller 220 to the lift valves 224. Accordingly, during normal operation of the control system, when the tilt command is high, the lift command is low, and as such, the tilt velocity is high and the lift velocity is low.

The tilt actuator may be configured to have hydraulic priority over the lift actuator. Therefore, when the implement controller 220 fully opens the tilt actuator valve 226, the lift actuator may receive no fluid, even if lift actuator valve 224 is fully open. As the tilt command is reduced from full power, thereby reducing the flow through tilt actuator valve 226, hydraulic fluid may then be used to operate the lift actuator.

The lift velocity and the tilt velocity may be measured by potentiometers on the actuator cylinders or by other means, as would be apparent to one skilled in the relevant art. The lift force may be measured by pressure transducers disposed within the lift actuators or within the lift actuator heads. Accordingly, when the working implement 104 is engaged with and moving through a pile, the lift force increases. If the working implement 104 is not engaged with a pile, the lift force will remain virtually unchanged, or may increase as the actuators rotate toward a more vertical position.

At a step 329, the system determines whether the bucket is full enough. This determination may be based on the position of the work implement as compared to a preset full-bucket position. For instance, if the work implement is fully tilted and fully lifted through the scooping process, then the tilt and lift will be beyond the preset full-bucket position. The preset full-bucket position may be set at any desired tilt and height position. If the preset full-bucket position is met or exceeded, then the command signal generator 216 ends the DIG mode at a step 331. The operator may manually drive the work machine to a desired location to manually dump the material from the work implement.

Alternatively, at step 329, the operator may visually determine that the bucket is full enough, and may end the DIG mode control merely by manually moving either tilt or lift control levers or by shutting off the control system, thereby overriding the control system and ending the system control at step 331. It should be noted that the operator may have the ability to override the control system at any time throughout any portion of the START and DIG modes, thereby ending the automatic control of the work machine.

If the bucket is not full, then the system monitors the tilt command at step 330 to determine whether the tilt command exceeds a pre-established threshold amount. If the working implement is deeply engaged within the pile, then the crowd factor should be relatively high. And as such, the tilt command is set high. As explained above, when the crowd factor and the tilt command are high, the lift command is set low, as tilt command and lift command are inversely related. If the tilt command exceeds the preset upper threshold value, then the control system determines that the working implement must be well into the pile. Accordingly, the command signal generator 216 drops the lift command to zero at a step 332. By setting the lift command at zero when the tilt command is above the tilt command threshold, the fluid pressure within the hydraulic circuit may achieve higher pressures than when the lift command is set at a value above zero.

As stated above, the crowd factor is continuously monitored at step 326. Therefore, as the lift force is reduced, the tilt command is likewise reduced according to the relationship between the tilt command and the crowd factor. As long as the tilt command is above the threshold, the system will hold the lift command at zero. As the crowd factor falls below the tilt command threshold, the lift command, and therefore the lift velocity, begins to increase inversely. The command signal generator 216 monitors the lift command to determine whether the lift velocity exceeds a threshold at a step 334.

At step 334, when the lift command and lift velocity do not exceed the preset threshold, there is acceptable resistance to lift, indicating that the work implement is properly engaged in the material pile. Accordingly, the system continues to operate by continually monitoring the crowd factor at step 326 to determine whether the bucket is sufficiently full.

Accordingly, when the lift velocity exceeds the preset lift velocity threshold at step 334, the system determines that the work implement is exiting the pile of material. In order to reduce the likelihood of lifting the work implement too high before the bucket is full, the lift command is reduced by a percentage factor at a step 340, thereby reducing the lift velocity. In one exemplary embodiment, the lift command is reduced by a factor of 50% from the preset lift threshold. In another exemplary embodiment, the lift command is reduced to 50% of the maximum lift capability. The lift command may be reduced or set to any desired preset value. Although the reduced lift command may be set at zero, it may be desirable to maintain at least a small lift velocity to enable the work implement to more easily penetrate a subsequent pile of material once the subsequent pile is engaged.

In one exemplary embodiment, the system may monitor a second crowd factor, such as, for example, driveline torque, to determine whether the crowd factor exceeds an "in-pile" threshold, as indicated at step 342. It should be appreciated that the second monitored crowd factor could be a factor other than driveline torque. The in-pile threshold of the second crowd factor is a designated value that indicates that the work implement has reengaged the original pile of material, or perhaps engaged a second pile of material. The designated in-pile threshold value for this second monitored crowd factor may be a preset value or may be a value that is captured as the work implement exits the pile of material at step 334. For instance, the in-pile threshold could be the value of the torque that is measured when the work implement began to exit the first pile of material.

If the torque exceeds the in-pile threshold value at step 342, indicating that the work implement has engaged resistance, then the system may output a maximum lift command at a step 344, raising the work implement as quickly as possible through the subsequent pile of material. It may be beneficial to set the lift command at a maximum value because the increased lift enables the work implement to more easily move through the pile. However, the lift command need not be set at a maximum value, but may be set at a lower lift value, as would be recognized by one skilled in the art.

If the torque does not exceed the in-pile threshold value at step 342, then the system determines whether certain stall conditions are met at a step 346. To determine whether the work implement is stalled, the system may monitor the lift velocity and the tilt velocity. If the tilt command and lift command are set at a value, but the tilt velocity and the lift velocity are substantially zero, then the work implement may be stalled. If the system determines that the stall conditions are not met, then the system continues to operate normally by monitoring the crowd factor at step 326.

When the system determines the stall conditions are met at step 346, the system responds by maximizing the lift at step 344 in order to break free of the stalled condition. Accordingly, if the system is stalled because the work implement is deeply engaged into the pile, by maximizing the lift command, the work implement may break free of the pile, thereby overcoming the stalled condition.

After maximizing the lift command at step 344, the system monitors the crowd factor at step 326 to determine when the lift command should be lowered, based on the measured crowd factor, and the lift and tilt command relationships as set forth above.

Figure 5:
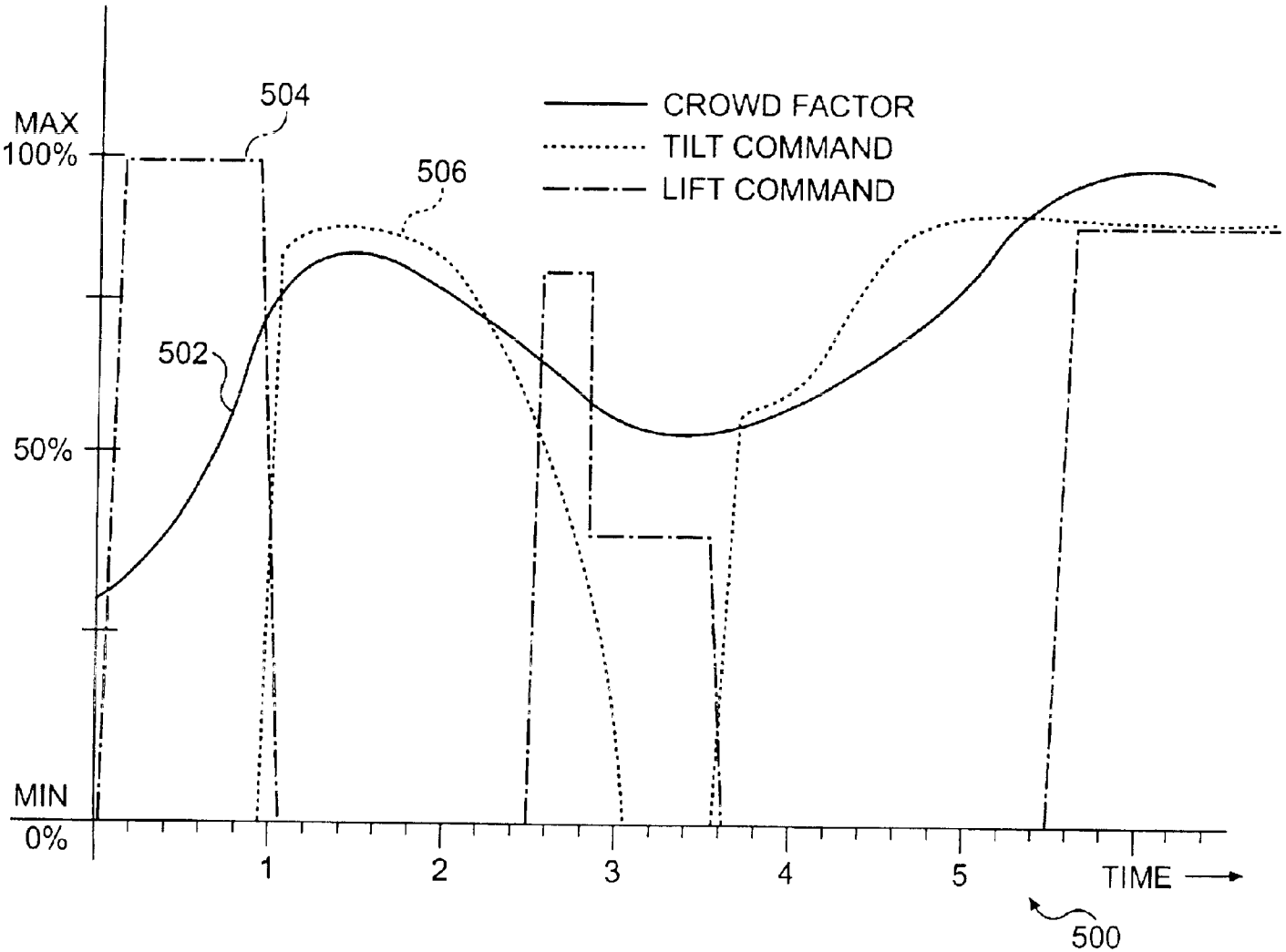
FIG. 5 is a graph showing an exemplary relationship of the crowd factor, tilt command, and lift command over time as the work machine of FIG. 1 is engaged with piles of material.

FIG. 5 is a graph that shows the relationship between the lift, tilt and crowd factors as work machine 100 engages first and second piles of material 110, 112, respectively of FIG. 1. Graph 500 includes a horizontal time axis showing time in seconds. It should be noted that graph 500 is exemplary only, and the actual time between any given change in crowd factor, lift command, or tilt command will vary depending on, for example, the location of the piles, the pile composition, the system settings, and other factors. Graph 500 also includes a vertical axis showing the effective output signals of the lift and tilt commands, and the crowd factor as a percentage of the maximum capacity. The effective output signals are the command settings. The effect of the command settings closely relates to the settings themselves.

On the graph, the crowd factor is represented by a solid line, the tilt command is represented by a dotted line, and the lift command is represented by a dashed line, as seen in the legend. At zero seconds on graph 500, work implement 104 of work machine 100 engages first pile of material 110, initiating the START mode. Because work implement 104 is entering first pile of material 110, crowd factor line 502 is shown as increasing. As described with reference to FIG. 3, when the crowd factor exceeds a minimum threshold, the START mode begins. Accordingly, also at about zero seconds, a maximum lift command is sent to the lift actuators, as shown by lift line 504.

The crowd factor continues to increase until it exceeds a DIG mode threshold, indicating that work implement 104 is fully engaged in first pile of material 110, which occurs on graph 500 at about 0.9 seconds. Accordingly, the control system initiates the DIG mode. Thus, a tilt command is initiated and sent to the actuators, as is shown by tilt command line 506. As the tilt command increases, the lift correspondingly decreases, as seen by lift line 504. Likewise, because tilt has hydraulic priority over lift, if tilt command is maximized, then the lift command is minimized or set at zero. Because lift is decreased, the resistance to lift also decreases and as such, the crowd factor begins to decrease as shown by crowd factor line 502 at about 1.4 seconds. Because the tilt command is based on the crowd factor, tilt command also begins to decrease as is shown by tilt line 504.

At about two seconds, work implement 104 begins to exit first pile of material 110. Accordingly, the crowd factor value continues to become lower, followed by a decrease in the tilt command. Also, at or around the time the crowd factor beings to decrease, the system captures the driveline torque value as a setting discussed below.

At about 2.5 seconds on graph 500, the tilt command decreases until it is below a threshold, reinstating the lift command, as shown by dashed lift line 504. Although the lift command line increases rapidly to a plateau, the lift command could increase at a slower rate in proportion to the decrease in lift command, and need not reach a plateau setting as shown.

At about 2.9 seconds, work implement 104 fully exits first pile of material 110. Because of the decreased resistance, the lift velocity increases beyond a set threshold. The system reduces the lift command by a factor, such as by 50%, as can be seen by the drop in lift command as shown by line 504.

Accordingly, when work machine is between first pile of material 110 and second pile of material 112, the lift command is maintained at the reduced value, as shown in the horizontal section of lift line 504 between about 3.0 and 3.5 seconds. The system monitors the torque to determine whether it exceeds the torque value captured at the point that the crowd factor began to decrease as described above.

On graph 500, at about 3.5 seconds, work implement 104 engages second pile of material 112. However, before the driveline torque exceeds the captured value, and because stall conditions are not met, the crowd factor increases as a result of engaging the second pile of material, which causes the system to generate lift and tilt commands. Accordingly, at about 3.5 seconds, the tilt command is maximized, as is shown by dotted tilt line. As such, the lift command drops to zero because the tilt command exceeds the preset value as is shown by lift line 504. The crowd factor continues to increase as second pile of material 112 is more fully engaged, thereby maintaining the tilt command at a maximum value.

At about 5.5 seconds, the system determines that the bucket is full. Consequently, the control system maximizes the tilt and lift commands until work implement 104 is fully tilted and lifted to a desired position. Because of hydraulic priority, the tilt command is shown at a maximum and the lift command is zero.

Figure 6:
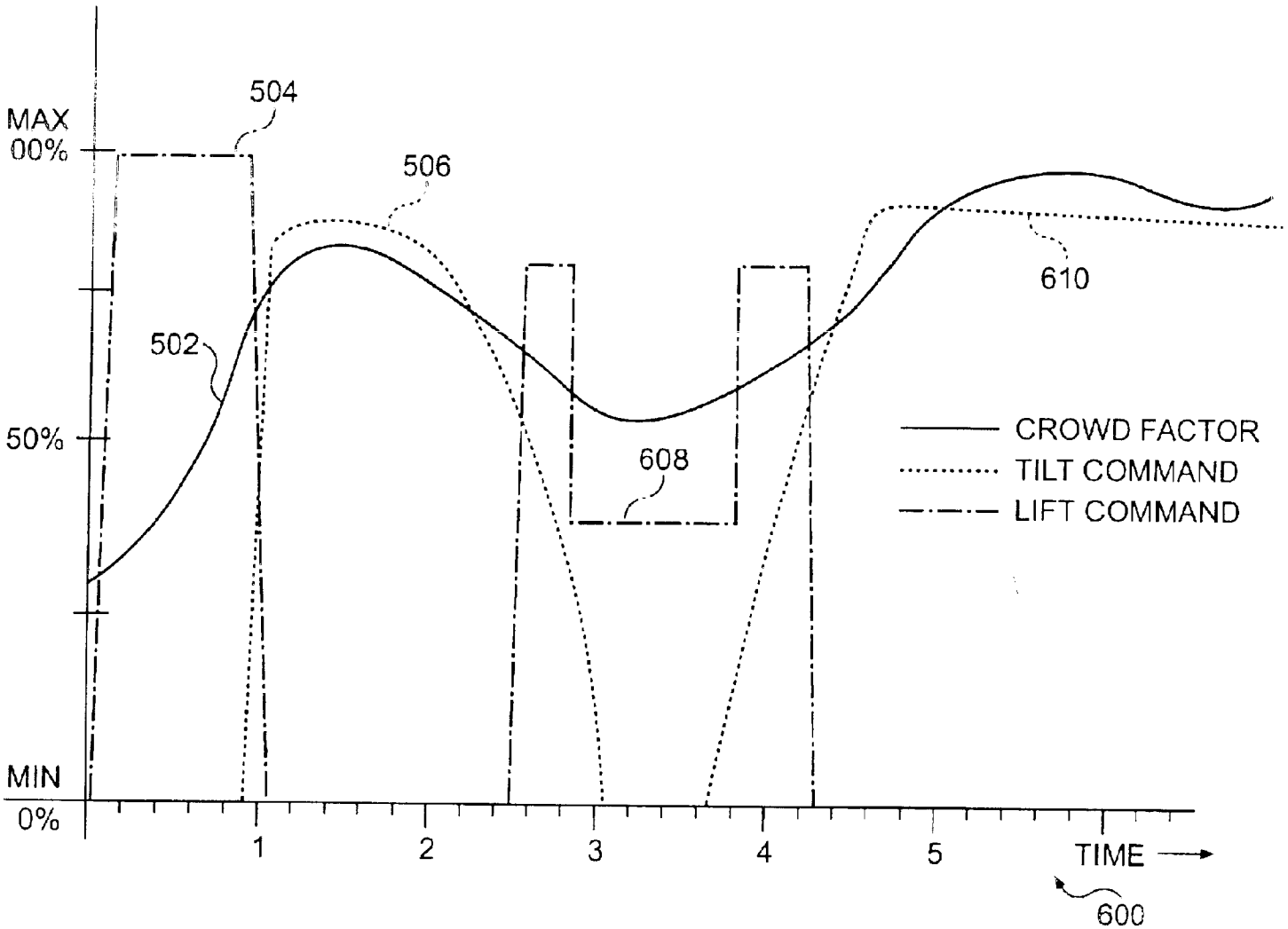
FIG. 6 is a graph showing another exemplary relationship of the crowd factor, tilt command, and lift command over time as the work machine of FIG. 1 is engaged with piles of material.

FIG. 6 is another graph showing the relationship between the lift, tilt, and crowd factors as the work machine of FIG. 1 engages a pile of material. Graph 600 is identical to graph 500 of FIG. 5 through about the first three seconds of operation. In FIG. 6, however, the second monitored crowd factor indicates that the work implement has fully engaged the second pile of material. In this exemplary embodiment, the second monitored crowd factor is the driveline torque.

As with the embodiment described in connection with FIG. 5, the system monitors the torque to determine whether the captured value is exceeded. At about 3.3 seconds, work implement 104 engages second pile of material 112, as can be seen by the increase in crowd factor line 502. However, at about 3.6 seconds, before the crowd factor increases beyond a preset level, the measured torque value exceeds the value previously captured. Accordingly, the lift command is set at a maximum value from a lift line 308 at about 3.8 seconds, as shown by lift line. Because of the increase in the crowd factor, the tilt command begins to increase, as shown by tilt line 610. At about 4.2 seconds, the tilt command exceeds a preset threshold, and the lift command is set at zero. The crowd factor continues to increase as second pile of material 112 is more fully engaged, thereby maintaining the tilt command at a maximum value.

At about 5.2 seconds, the system determines that the bucket is full. Consequently, the control system maximizes the tilt and lift commands until work implement 104 is fully tilted and lifted to a desired position. Because of hydraulic priority, the tilt command is shown at a maximum and the lift command is zero.

INDUSTRIAL APPLICABILITY

The present invention adjusts the lift command and lift speed based on the variations in ground speed during the work process. As such, the work implement smoothly and consistently operates although an operator may shift gears when approaching or engaging the dig site. Thus, the system takes into account both engine speed and gearing in adjusting the automated dig cycle.

Furthermore, the present invention may monitor the conditions of the work implement to determine whether the work implement is exiting a pile of material before the work implement is fully filled. This improves efficiency by ensuring that the work implement is fully filled before dumping the material elsewhere, reducing the number of scoop and dig cycles required to move a given amount of material.

The automatic control system is particularly useful when material is dumped from dump trucks onto the ground to be picked up or moved elsewhere by the work machine. Dump truck operators are not always able to dump their load directly on a pile already on the ground. Accordingly, subsequent piles of material are often dumped in front of an original pile of material. The disclosed system allows the work machine to automatically dig and fill the work implement from more than one pile, regardless of the location and size of the piles.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for controlling an automatic bucket control system during loading of a work implement of a work machine, the method comprising:

determining when the work implement engages a pile of material;

initiating the automatic bucket control system in response to the work implement engaging the pile of material;

determining a ground speed of the work machine; and generating a lift command based upon the ground speed, wherein the lift command is reduced as the ground speed reduces.

2. The method of claim 1, wherein the lift command is maintained above a minimum threshold value regardless of the ground speed.

3. The method of claim 1, further including monitoring the gear in which the work machine is operating, the relationship between the lift command and the ground speed being dependent on the determined gear.

4. The method of claim 1, wherein the lift command is maximized before the ground speed reaches a maximum level.

5. A work machine comprising:

a work implement; configured to engage and lift material from a pile of material;

lift and tilt actuators configured to operate the work implement; and a control system configured to control the work implement, the control system including, a sensor configured to monitor a ground speed of the work machine, and a command signal generator configured to output a command signal based on the sensed ground speed to control the lift and tilt actuators, wherein the command signal generator is configured to modify the command signal in response to changes in the sensed ground speed.

6. The work machine of claim 5, wherein the command signal generator is configured to compare the ground speed to a maximum ground speed for each transmission gear and to calculate a comparison value, wherein the command signal generator is configured to output the lift command based on the comparison value.

7. The work machine of claim 6, wherein the comparison value is a percent deviation from the maximum ground speed.

8. The work machine of claim 5, wherein the command signal generator includes a processor configured to receive data representing the actual ground speed.

9. The work machine of claim 5, further including an implement controller configured to receive lift commands and configured to convert the lift commands into control signals for activating an actuator valve for the lift actuator.

10. A method for controlling an automatic bucket loading control system during loading of a work implement of a work machine, the method comprising:

monitoring a crowd factor;

determining when the work implement fully engages a pile of material based on the monitored crowd factor;

initiating the automatic bucket loading control system in response to the work implement fully engaging the pile of material;

adjusting the tilt and lift commands based on the monitored crowd factor;

determining when the work implement is leaving the pile of material; and setting the lift command at a lower value.

11. The method of claim 10, wherein the tilt command has priority over the lift command.

12. The method of claim 10, wherein the tilt command increases in response to an increase in the monitored crowd factor.

13. The method of claim 12, wherein the lift command increases in response to a decrease in tilt command.

14. The method of claim 10, wherein determining when the work implement is leaving the pile of material includes monitoring the lift velocity, wherein if the lift velocity exceeds a set threshold velocity, the lift command is set at a lower value.

15. The method of claim 10, wherein the crowd factor is a lift force.

16. The method of claim 10, wherein when lift and tilt velocities are zero for a set period of time, the lift command is set at a maximum lift command.

17. The method of claim 10, including monitoring a second crowd factor and outputting a lift command when the second crowd factor exceeds a designated value.

18. A work machine comprising:

a work implement;

lift and tilt actuators configured to operate the work implement; and a control system configured to automatically control the work implement of the work machine, wherein the control system is configured to operate the lift and tilt actuators, the control system including, a crowd factor sensor configured to monitor a crowd factor, and a command signal generator configured to adjust tilt and lift commands based on the monitored crowd factor value, wherein the control system is configured to determine when the work implement is leaving the pile of material based on the crowd factor and configured to set the lift command at a lower value.

19. The work machine of claim 18, further including a tilt position sensor and a lift position sensor configured to measure tilt and lift velocities, wherein the command signal generator receives data representing the tilt and lift velocities.

20. The work machine of claim 18, wherein the tilt actuator is configured to have hydraulic priority over the lift actuator.

21. A method for automatically operating tilt and lift actuators for loading a work implement of a work machine with material using an automatic control system, the method comprising:

monitoring a crowd factor;

determining when the work implement engages the material based on the monitored crowd factor exceeding a first value;

determining an actual ground speed of the work machine;

generating a lift command and sending the command as a signal to the lift actuator, the lift command being based on the actual ground speed;

determining when the work implement fully engages with the material based on the monitored crowd factor exceeding a second value; and adjusting the tilt command and a lift command based on the monitored crowd factor.

22. The method of claim 21, further including monitoring the gear in which the work machine is operating, the relationship between the lift command and the ground speed being dependent on the determined gear.

23. The method of claim 21, wherein the tilt command has hydraulic priority over the lift command.

24. The method of claim 21, wherein the tilt command increases in response to an increase in the monitored crowd factor.

25. The method of claim 21, further including monitoring the lift velocity, wherein if the lift velocity exceeds a set threshold velocity, the lift command is set at a lower value.

26. The method of claim 21, further including monitoring lift and tilt velocities, wherein when lift and tilt velocities are zero for a set period of time, the lift command is set at a maximum lift command.

27. The method of claim 21, further including monitoring a second crowd factor and outputting a lift command when the second crowd factor exceeds a designated value.

* * * * *